United States Patent [19]

Bardy

[11] 4,182,169

[45] Jan. 8, 1980

[54] TENSION DETECTOR FOR AN ADVANCING YARN LAYER

[75] Inventor: Michel Bardy, Mulhouse, France

[73] Assignees: Institut Textile de France, Bologne; Agence Nationale de Valorisation de la Recherche, Neully S, Seine, both of France

[21] Appl. No.: 948,898

[22] Filed: Oct. 5, 1978

[30] Foreign Application Priority Data

Oct. 6, 1977 [FR] France ..... 77 30125

[51] Int. Cl.[2] ..... G01L 5/04

[52] U.S. Cl. ..... 73/160; 73/144; 73/829

[58] Field of Search ..... 73/143, 144, 159, 160, 73/826, 828, 829; 57/352

[56] References Cited

U.S. PATENT DOCUMENTS

| | | | |
|---|---|---|---|
| 2,444,245 | 6/1948 | Campbell | 73/144 |
| 2,695,519 | 11/1954 | Lodge | 73/144 |
| 2,833,145 | 5/1958 | McCullouch | 73/144 |
| 3,386,145 | 6/1968 | Harris | 73/160 |
| 3,880,001 | 4/1975 | Hogan | 73/160 |
| 4,000,641 | 1/1977 | Lewis | 73/160 X |

FOREIGN PATENT DOCUMENTS

| | | |
|---|---|---|
| 1407184 | 6/1965 | France . |
| 2053997 | 4/1971 | France . |

*Primary Examiner*—John Petrakes

*Attorney, Agent, or Firm*—Lewis H. Eslinger

[57] ABSTRACT

Tension detector for an advancing layer of straightened yarns.

A section of yarns of the layer 5 is guided along a V-path 5*a* by means of three guide member 1,4 of which a first group 1 is situated on one side of the layer 5 and a second group 4 is situated on the other side of the said layer and between the two members 1; the relative positions of the axes of the three guide members 1,4 are fixed and the force exerted by the yarn layer 5 on one of the said groups of members is measured with respect to that (or those) of the other group.

The invention is particularly applicable to the slashing of yarn warps on a slasher.

5 Claims, 7 Drawing Figures

TENSION DETECTOR FOR AN ADVANCING YARN LAYER

The present invention relates to a tension detector for an advancing yarn layer, of the type comprising a frame; and means mounted on this frame for guiding the yarns of the layer along a V-path, these means comprising: two counter-bracing rollers of parallel axes and means for assembling a rotating support member whose axis is parallel to the axes of the said rollers and situated between said latter, these means being rigidly connected to the frame by means of a support element provided with strain gauges.

A tension detector for a yarn layer is already known from French Pat. No. 1,407,184. In this device, the support member—or feeler member—is applied on to the yarn layer by means of a helical spring, and bearing, on the one hand, on the frame and, on the other hand, on a support of the feeler member; this support is slidably mounted on the frame in a direction which is perpendicular to the axis of the feeler member, and the displacement of this support is measured with respect to the frame.

By its inertia, this movable support makes it impossible for the known device to measure instantaneous values of tensions which are subject to sudden variations or of tensions varying in a cyclic manner, at high frequencies.

Moreover, the use of a spring, of which the linearity is never perfect and which is not safe from plastic deformations, makes this known device inaccurate and unreliable.

It should further be noted that in this known device, the length of the V-path of the yarn layer varies as a function of the tension of said sheet, so that the measuring conditions are not exactly the same for tensions of quite different values; This is an additional cause for wrong measurements and makes the known device quite inaccurate and not very reproducible.

Also, an article published in the "RAYON REVUE" No. 12, 1968, pages 138 to 151, discloses a tensiometer for a moving yarn which comprises two guide pulleys (f) and one sensor pulley (e) mounted at the free end of a pulley arm which is mounted by its other end on the frame of the apparatus. This arm is formed by two superimposed spring blades, superimposed and rigidly joined together at each end; each blade is provided, on each face, with a strain gauge (see FIG. 3). The yarn, of which the tension is to be measured, is guided along a V-path (see FIG. 2 of said article).

This known device nevertheless uses rotating guide members (pulleys (e) and (f) mounted cantilevered on the frame of the apparatus.

This is not harmful when the tension of only one yarn or cable is to be measured, and this is in fact what this document means to be doing.

On the contrary, when the intention is to measure the tension of a yarn or cable layer, such a cantilevered assembly would give inaccurate measurements especially because the yarns farthest away from the frame of the apparatus would act on the force sensor of the said apparatus through a lever arm longer than that through which the yarns closest to the said frame would act.

Another tensiometer is also known from French Pat. No. 2,053,997, which comprises two parallel pulleys (2) mounted on an arm (3) which is fixed in its centre on an axis (4). A cable (1) is guided on a path in (5) by two guide members situated in two fixed points (A) and (B) and by the two pulleys (2), so that the cable (1) applies a torque on the assembly composed of the pulleys (2) and the arm (3), which torque is centered about the axis (4), and is measured by a strain gauge (6).

This known device however is not adapted to measure the tension of a yarn layer because, to allow an easy insertion of this device into the said sheet of threads, the two pulleys should necessarily be mounted on a support which is itself overhung and here again we find the disadvantages mentioned hereinabove about the device described in the articles from "RAYON REVUE".

It is a particular object of the invention to propose a device of which the fitting on the yarn sheet is particularly easy, and which gives an accurate and reproducible measurement of the tension of an advancing yarn sheet.

This object is attained according to the invention because the subject element is provided with means for adjusting the said assembly means of the said support member with respect to the common plane of the axis of the said counter-bracing rollers in two predetermined fixed positions, one so-called assembly position, being that which permits the passage of a plane between a rotary support member mounted on the said assembly means, on the one hand, and the said counter-bracing rollers, on the other hand, and the other so-called measuring position, resulting from the first after a displacement towards each other of the said common plane and of the axis of the said support member, which displacement goes beyond the position at which a plane can no longer be inserted between the support member and the counter-bracing rollers.

Advantageously, the assembly means comprise a plurality of parallel arms fixed at one end on a cross-member connected to the support element, each arm being provided with a side notch, the support member comprising several coaxial runners each of which is mounted in the notch of a corresponding arm, each one of said arms ending into a bevelled free end.

Advantageously, the support member comprises a roller movably mounted on said assembly means.

Advantageously, the counter-bracing pulleys are interconnected, in rigid manner, at their two ends by means of two arms of the frame and the support element is essentially situated between these two arms in orthogonal projection on the common plane of the axes of the counter-bracing rollers.

Thus, the present invention ensures a possibility for the sensor member, of being placed in two stable positions, one of which allows the insertion of the yarn layer between the rotating members, whilst the other allows the measurement of the tension of the layer, this possibility constituting a decisive characteristic permitting the production of a tensiometer for an advancing yarn layer.

Another advantage of this detector device is its accuracy; indeed there is in this apparatus no parts which move during measurement (apart from the rotation about their axes of the counter-bracing rollers and of the support member), hence no friction likely to entail wear and errors of measurements.

Moreover, the pass band of this detector is only limited by the electronics associated to the force sensor. It is therefore possible, with this tension detector, to record with accuracy, very fast variations of tension, for example in a loom.

It is also possible to measure the tension in any part of a yarn layer, since the detector device can be introduced anywhere, from the selvedge of the layer to the centre thereof.

Other characteristics and advantages of the invention will be more readily understood on reading the following description of two examples of embodiments, reference being made to the accompanying drawings in which.

Figure 1:
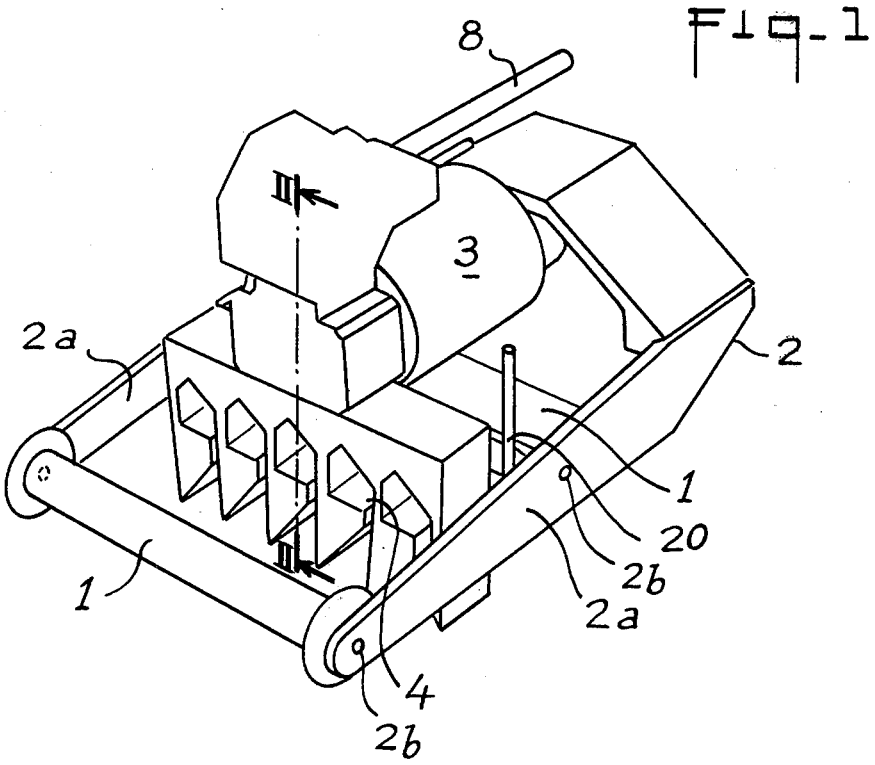
FIG. 1 is a perspective view of a tension detector according to one embodiment of the invention.
Figure 5:
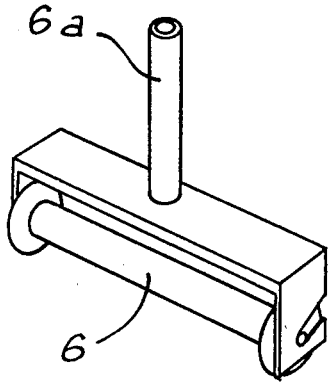
Figure 2:
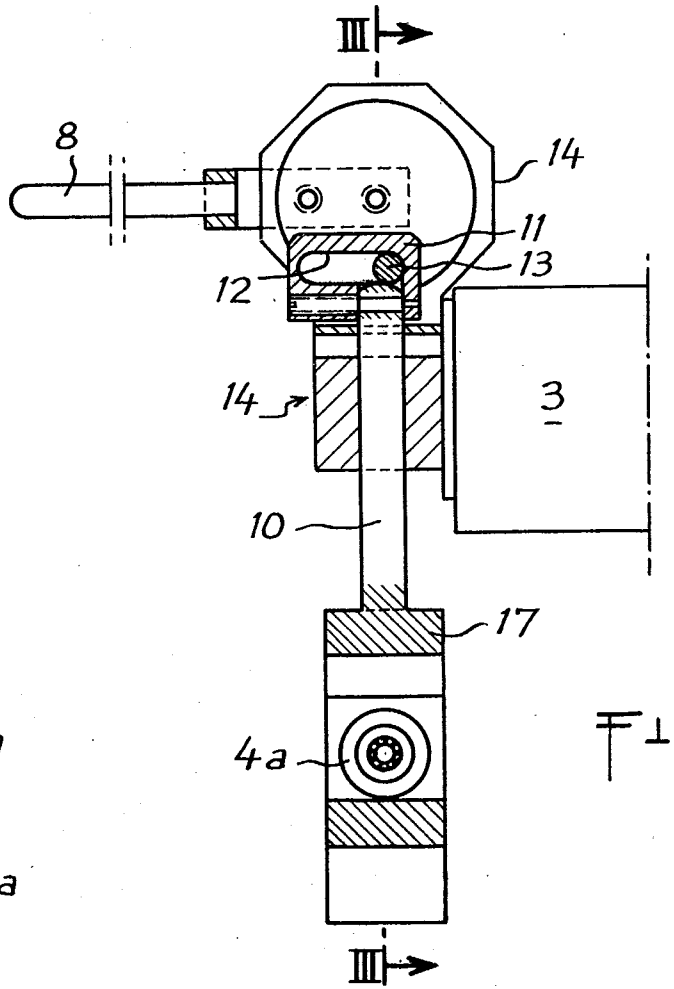
FIG. 2 is a partial cross-section along plane II of the FIG. 1.
Figure 3:
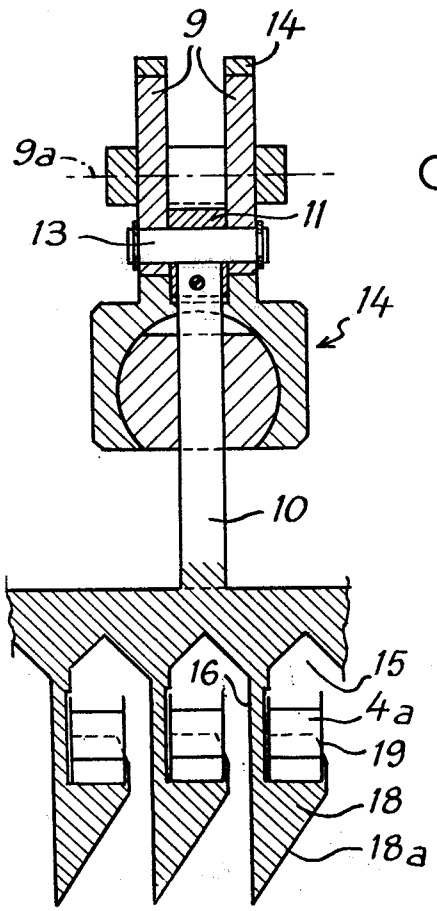
FIG. 3 is a cross-section along plane III—III of FIG. 2.
Figure 4A:
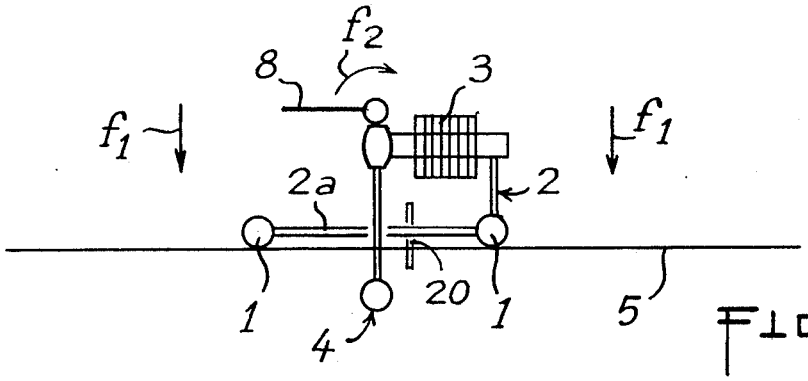
Figure 4B:
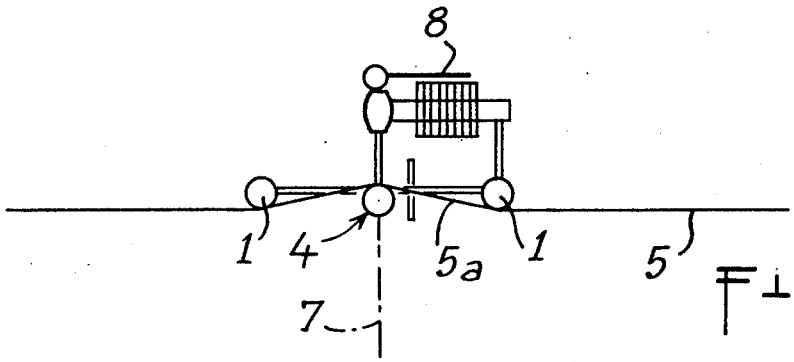
Figure 4C:
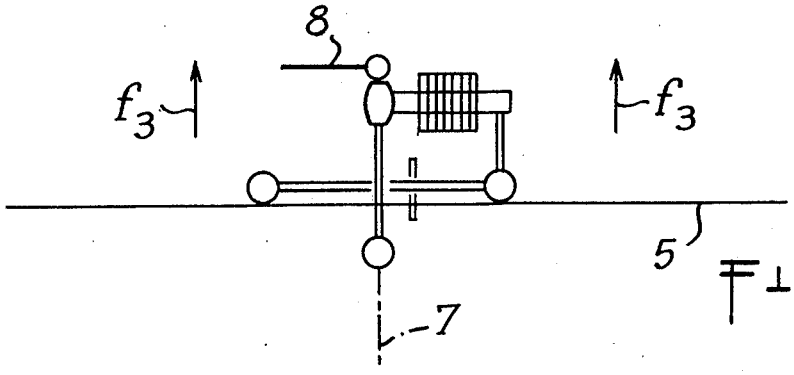

FIGS. 4*a* and 4*c* illustrate diagrammatically the assembly and functioning of the tension detector shown in FIGS. 1 to 3; and FIG. 5 is a second embodiment of the feeler member of the tension detector according to the invention.

The device, object of the invention and shown in the drawings, comprises two secondary rollers-or counter-bracing rollers—1, freely rotating, situated in parallel to each other and joined together in rigid manner at each end by a side arm—or side plate—2*a* of a carrier frame 2. To this effect, each roller 1 is mounted, at each end, in a bearing 2*b* provided in the adjacent side plate 2*a*. A force sensor 3 is fixed by one of its ends to the carrier frame 2 by rigid fastening means (not shown). At the other end of the said sensor 3 is mounted the feeler member proper 4, situated between the two secondary rollers 1 and half-way thereof. Said feeler member 4 is easily interchangeable so as to be adapted to different cases and therefore it can have different principles and shapes.

In the plane formed by the four bearings 2*b*, the sensor 3 is projected orthogonally between the side plates 2*a*, preferably halfway of said latter. The sensor 3 is for example composed of one or more mechanical elements rigidly connecting the carrier frame 2 to the feeler member 4 and comprising, in manner known per se, one or more strain gauges connected to electronic measuring and/or recording devices.

In the example shown in FIGS. 1 to 3, the feeler member 4 is a multi-roller system comprising a plurality of co-axial feeling rollers 4*a*; which system permits the positioning of the device anywhere in a yarn layer 5.

According to another embodiment shown in FIG. 5, the element 4 is constituted by a roller 6 movably mounted on a support 6*a* which is placed and secured, in a corresponding housing, by the underneath of the yarn layer 5 after the device has penetrated the latter. The advantage of this embodiment is to reduce to a minimum any perturbations in the density of the layer, which could be most troublesome for example in the case of slashing the yarn warps on slashers.

The feeler member 4 can take two stable positions in the intermediate vertical plane 7 of the axes of the secondary rollers 1, which positions correspond to the two phases of the measurement, i.e. (1) the positioning (or removal) of the whole device on (or from) the yarn layer 5 and (2) holding said device in position for the measurement proper. An operating device makes it possible to set the feeler member 4 into either of the aforesaid positions.

Such device, shown in detail in FIGS. 2 and 3, comprises an operating lever 8 radially mounted on a pair of co-axial eccentric discs 9 acting in known manner on an axially-sliding connecting rod 10 or 6*a* of the member 4. To this effect, a connection member 11 mounted at the upper end of the rod 10 is provided with a groove 12 which is perpendicular to the axis of the rod 10–6*a* in which is engaged a bar constituting an eccentric tenon 13 of the discs 9. Said latter are mounted to rotate about their axis 9*a* in a support 14 which is mounted at the end of the force sensor 3 opposite the carrier frame 2. The rod 10–6*a* is mounted so as to slide axially in the support 14.

When the feeler member 4 is of the "multi-roller type" (FIGS. 1, 2 and 3), each roller 4*a* is mounted in a side notch 15 provided at the free end of a corresponding arm 16. The arms 16 are parallel, downwardly directed and joined together at their upper end by means of a cross member 17 secured to the lower end of the rod 10. The free end of each arm 16 has a downwardly bevelled excrescence 18, downwardly defining the notch 15. The bevelled ends 18 of the arms 16 facilitate the insertion of the apparatus in the yarn layer 5, the inclined face 18*a* of the bevel being immediately followed by the outer side plate 19 of the corresponding roller 4*a*.

Finally, a comb 20 may be placed transversely in order to facilitate the insertion of the device into the layer, or its removal, when the "multi-roller system" option is used.

Thus, for positioning the device on the yarn layer 5, the element 4 is placed in a so-called assembly position, such as shown in FIG. 4*a*, the element 4 being shifted downwardly with respect to the common plane of the axes of rollers 1 so that a plane may be inserted between the said rollers 1, on the one hand, and the rotating member 4*a* or 6, on the other.

By a movement along arrows $f_1$ (FIG. 4*a*), the rollers 1 are set on the sheet 5. Then, by pivoting the lever 8, 180° in the direction of arrow $f_2$, the element 4 is brought in a so-called measuring position (FIG. 4*b*) for which the sheet 5 is "gripped" between rollers 1, on the one hand, and the element 4, on the other, so as to be guided along a very open V-path over a section 5*a*.

The removal apparatus is effected by simply returning the element 4 to its assembly position which means pivoting the lever 8 back to its starting position (FIG. 4*c*), and by moving the apparatus in the direction of arrows $f_3$ away from the sheet 5.

It should be noted that the two (assembly and measuring) positions of the feeler member 4 are stable positions, the bar 13 being in abutment against the end 12*a* (situated on the right in FIG. 2) and the lever 8 being horizontal. This way, any major increase in the tension of the yarns of the layer 5 entails no relative displacement of the feeler member (in the measuring position) with respect to the counter-bracing rollers 1. As a result, the length of the V-path of the section 5*a* of the yarns of layer 5 is unchanged.

The device according to the invention can be used in all cases where measurement of the tension of a yarn layer has to be accurate and reproducible, i.e. in manufacturing work-shops or in laboratories, where, for example in order to ensure the quality of a product made from a yarn layer, it is necessary that the mean tension of these yarns be uniform.

This device is also particularly well adapted for measuring the tension of yarns in a layer of which the selvedges are not accessible to measurement.

In view of the aforesaid advantages, many applications should be found for this apparatus:

first in the textile industry, in connection with warping, slashing, weaving and knitting, and in other industries such as drawing-mills, and manufactures of wires and technical gauzes, etc.

This apparatus also has, owing to the electronics associated thereto, the possibility of being synchronized with a movement. For example, let us consider the tension of a yarn layer on a loom: this tension has a cyclic variation and it is possible to obtain the valve of this tension any time during the cycle.

Finally, it is of course possible to mount this tension detector on a rigid base in order to make recordings over a long period of time.

Various modifications may of course be made by any one skilled in the art the devices or methods, described hereinabove by way of non-restrictive examples, without departing from the scope of the invention.

In particular, the eccentric operating device 8 to 14 may be replaced by an electromechanic, pneumatic or other control device.

I claim:

1. A tension detector for an advancing layer of straightened yarns, comprising a frame; and means mounted on said frame for guiding the layer along a V-path, said means comprising: two counter-bracing rollers mounted on said frame for rotation about parallel axes in a common plane, a rotatable feeler member, and a support member for mounting the feeler member in a frame with the longitudinal axis of the feeler member parallel to the axes of said counter-bracing rollers and situated between the latter, said support member including strain gauges, and means for moving said feeler member in the frame between first and second positions with respect to the common plane of the axes of said counter-bracing rollers, said first position being a fitting position which allows the passage of a plane of yarn between the rotating feeler member and the said counter-bracing rollers and said second position being the measuring position wherein the feeler member is located at a position between the bracing rollers at which a plane of yarn can no longer be inserted between the feeler member and the counter-bracing rollers; said support member including a cross-member and a plurality of parallel arms secured at one end on said cross-member, each arm having a side notch formed therein, and said feeler member comprising a plurality of coaxial rollers each of which is mounted in the notch of a corresponding arm, and each arm extending into a beveled free end.

2. A tension measuring device for a layer of straightened yarn, comprising:

a frame, a pair of parallel counter-bracing rollers rotatably mounted on said frame for rotation about their longitudinal axes and lying in a common plane, a rotatable feeler member having a longitudinal axis extending parallel to the axes of said counter-bracing rollers, a feeler support member, said feeler member being mounted for rotation about its longitudinal axis on said feeler support member, means rigidly connected to said frame for mounting said feeler support member on said frame for reciprocating movement between first and second fixed positions relative to the plane of said counter-bracing rollers, said mounting means including strain gauge means, and means for setting the axis of said feeler member, with respect to the common plane of the axes of the counter-bracing rollers, in said first and second predetermined fixed positions, said first position being a fitting position wherein said feeler is located out of said common plane to allow the passage of a plane layer of yarn to pass between the feeler member and the counter-bracing rollers, and said second position being a measuring position wherein the feeler member is located and between the counter-bracing rollers in a position at which a plane layer of yarn can no longer be inserted between the support member and the counter-bracing rollers and is deflected thereover.

3. A tension measuring device as defined in claim 2, wherein said feeler support means comprises a cross-member and a plurality of parallel arms secured at one end of the cross-member, said cross-member being connected to said mounting means, said arms each having a side notch formed therein, said feeler member comprising a plurality of coaxial rollers respectively mounted in the side notches of said arms, and each arm having a bevelled free end.

4. A tension measuring device as defined in claim 2, wherein said feeler member comprises a roller rotatably mounted on the said feeler support member.

5. A tension measuring device as defined in any one of claims 2, 3 or 4, wherein said frame includes a pair of parallel arms, and said counter-bracing rollers are rigidly interconnected at their opposed ends by said two arms of the frame, said feeler member being located between said two frame arms and projecting in an orthogonal manner over said common plane of the axes of the counter-bracing rollers.

* * * * *